US008376720B2

(12) United States Patent
Rosalik, Jr.

(10) Patent No.: US 8,376,720 B2
(45) Date of Patent: Feb. 19, 2013

(54) OUTER RING DRIVEN GEROTOR PUMP

(75) Inventor: Martin E. Rosalik, Jr., Oakland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 425 days.

(21) Appl. No.: 12/718,250

(22) Filed: Mar. 5, 2010

(65) Prior Publication Data

US 2011/0217192 A1 Sep. 8, 2011

(51) Int. Cl.
*F04B 17/03* (2006.01)
*F01C 1/10* (2006.01)

(52) U.S. Cl. ..... 417/356; 417/410.4; 418/171

(58) Field of Classification Search ..... 417/356, 417/410.4; 418/171
See application file for complete search history.

(56) References Cited

U.S. PATENT DOCUMENTS 2,871,793 A * 2/1959 Michie et al. ..... 417/356
5,219,277 A * 6/1993 Tuckey ..... 417/366
6,053,705 A * 4/2000 Schob et al. ..... 417/53
7,318,511 B2 * 1/2008 Grogg ..... 192/85.02
7,695,260 B2 * 4/2010 Holtzapple et al. ..... 418/104
7,726,959 B2 * 6/2010 Holtzapple et al. ..... 418/77
7,753,822 B2 * 7/2010 Weinschenker et al. ..... 477/3
8,038,423 B2 * 10/2011 Nakayoshi ..... 418/171
8,113,794 B2 * 2/2012 Schneider et al. ..... 417/356
2006/0267540 A1 * 11/2006 Chu et al. ..... 318/778
2009/0142208 A1 * 6/2009 Rhein et al. ..... 417/410.3
2010/0099537 A1 * 4/2010 Maten et al. ..... 477/130

* cited by examiner

*Primary Examiner* — Charles Freay

(57) ABSTRACT

A gerotor pump includes an inner ring and an outer ring. The inner ring is rotateable about an axis, where the inner ring has an outer diameter contact surface. The outer ring has an inner diameter contact surface that defines a central opening. The central opening receives the inner ring, and a portion of the inner diameter contact surface engages a portion of the outer diameter contact surface of the inner ring. A motor including a rotor and a stator that surrounds the rotor is included. The rotor surrounds the outer ring and exerts a driving force on the outer ring such that the outer ring rotates about the inner ring. The inner diameter contact surface of the outer ring and the outer diameter contact surface of the inner ring create a plurality of chambers. Rotation between the inner ring and the outer ring expand and contract the chambers to expel fluid from the gerotor pump.

18 Claims, 4 Drawing Sheets

OUTER RING DRIVEN GEROTOR PUMP

FIELD

The present disclosure relates to a gerotor pump having an inner ring, an outer ring, and a motor, and more particularly to a gerotor pump where the outer ring is driven by a rotor of the motor.

BACKGROUND

The statements in this section merely provide background information related to the present disclosure and may or may not constitute prior art.

Transmission oil pumps are typically mounted to the transmission case above the oil fill level and are driven by a separate electric motor, such as a permanent magnet type motor. The transmission oil pump requires a relatively high starting torque from the motor, especially in colder temperatures (usually less than about −25° C.). Sometimes the motor is unable to provide the required starting torque, which results in the transmission oil pump stalling.

In addition, typical transmission oil pumps include a hydraulic passage, such as a suction tube, that is used to deliver oil from an oil pan to the transmission oil pump. However, several issues may arise when employing a suction tube to deliver oil to the transmission oil pump. For example, the suction tube is typically sealed by an O-ring which can fail, causing an oil leak. Moreover, because the transmission oil pump is located above the oil fill level of the transmission, cavitation may occur in the suction tubes during high flow rates, and the priming time of the oil pump may be increased.

Accordingly, while current transmission oil pumps achieve their intended purpose, there is a need for a new and improved transmission oil pump which exhibits improved performance from the standpoints of improved starting torque, reduced cavitation, and reduced leakage.

SUMMARY

The present invention provides a gerotor pump having an inner ring and an outer ring. The inner ring is rotateable about an axis, where the inner ring has an outer diameter contact surface. The outer ring has an inner diameter contact surface that defines a central opening within the outer ring. The central opening receives the inner ring and a portion of the inner diameter contact surface engages a portion of the outer diameter contact surface of the inner ring. A motor is provided including a rotor and a stator that surrounds the rotor. The rotor surrounds the outer ring and exerts a driving force on the outer ring such that the outer ring rotates about the inner ring. The inner diameter contact surface of the outer ring and the outer diameter contact surface of the inner ring creates a plurality of chambers. Rotation between the inner ring and the outer ring expand and contract the chambers to expel fluid from the gerotor pump.

In an embodiment of the present invention the rotor and the outer ring are integrated into a single component.

In another embodiment of the present invention the rotor is connected to the outer ring by one of a driving member and a splined engagement.

In yet another embodiment of the present invention the motor is a three phase motor.

In an embodiment of the present invention the motor is end wound.

In another embodiment of the present invention the motor includes a plurality of windings that dissipate heat to fluid located in the gerotor pump.

In yet another embodiment of the present invention the gerotor pump includes an inlet side, where the inlet side includes an inlet screen.

In an embodiment of the present invention the gerotor pump includes an outlet port, where the outlet port expels fluid into an inlet of a control valve.

In another embodiment of the present invention the gerotor pump includes a housing that is part of a control valve body.

In an embodiment of the present invention a transmission is provided including a reservoir and a gerotor pump. The reservoir is for receiving fluid, and includes an interior volume. The gerotor pump is at least partially located within the interior volume of the reservoir. The gerotor pump includes an inner ring and an outer ring. The inner ring is rotateable about an axis, where the inner ring has an outer diameter contact surface. The outer ring has an inner diameter contact surface that defines a central opening within the outer ring. The central opening receives the inner ring and a portion of the inner diameter contact surface engages a portion of the outer diameter contact surface of the inner ring. A motor is provided including a rotor and a stator that surrounds the rotor. The rotor surrounds the outer ring and exerts a driving force on the outer ring such that the outer ring rotates about the inner ring. The inner diameter contact surface of the outer ring and the outer diameter contact surface of the inner ring creates a plurality of chambers. Rotation between the inner ring and the outer ring expand and contract the chambers to expel fluid from the gerotor pump.

In an embodiment of the present invention the reservoir is a transmission oil pan.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
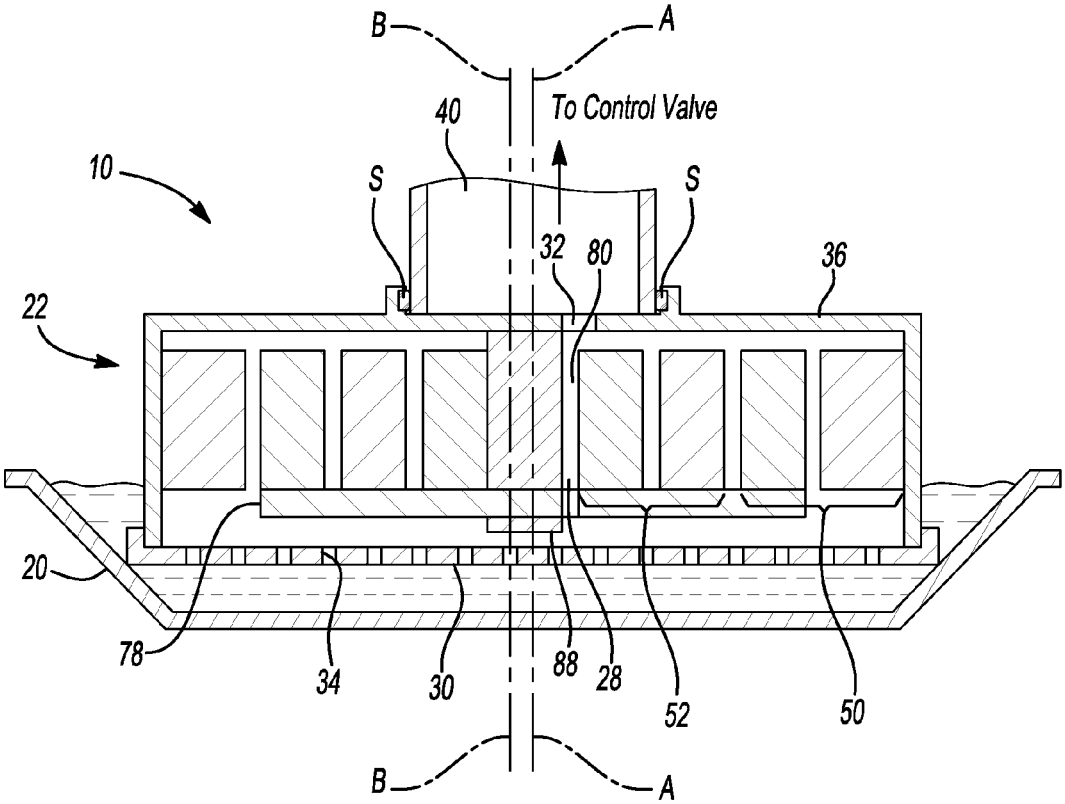
FIG. 1 is an illustration of an exemplary fluid delivery system including a reservoir and a pump.

With reference to FIG. 1, a fluid delivery system is generally indicated by reference number 10. The fluid delivery system 10 includes a sump or reservoir 20 and a pump 22, where the pump 22 is at least partially located within an interior volume of the reservoir 20. The reservoir 20 may be any type of container for receiving a quantity of fluid such as, for example, a transmission oil. In the example as illustrated, the fluid delivery system 10 is part of a transmission (not shown), where the reservoir 20 is a transmission oil pan or sump located at a bottom of the transmission. The pump 22 draws a quantity of transmission oil from the oil pan 20 and delivers oil to the internal components of the transmission. It should be appreciated that the fluid delivery system 10 is exemplary only, and that various configurations of fluid delivery systems may be employed with the present disclosure.

The pump 22 includes a pump inlet 30 and a pump outlet port 32. At least the pump inlet 30 is submerged by fluid located within the interior volume of the reservoir 20. As a result, fluid is suctioned into the pump inlet 30 directly from the reservoir 20. Alternatively, the pump 22 may be totally submerged within the reservoir 20. The pump inlet 30 includes a screen 34 that acts as a filter for removing impurities from fluid located in the reservoir 20 before entering the interior of the pump 22. The screen 34 is attached to the pump 22 using any type of fastening configuration such as, for example, a snap-fit engagement between the screen 34 and a housing 36 of the pump 22. In one embodiment, the screen 34 is constructed from a polymer based material. The screen 34 can also include a generally square or rectangular cross section in an effort to increase the overall surface area.

The pump 22 is packaged in the location where the oil filter would typically be found in a conventional transmission configuration. The screen 34 of the pump 22 filters impurities from fluid located in the reservoir 20, thus a separate oil filter is not needed. Moreover, the pump inlet 30 is submerged by fluid located within the interior volume of the reservoir 20, thus a separate suction tube to deliver fluid from the reservoir 20 to the pump 22 can be omitted. Also, because the screen 34 is attached to the pump 22, the complexity and overall number of parts associated with the transmission is also reduced. For example, a separate oil filter and the associated attachment features can be omitted from the fluid delivery system 10.

The pump 22 receives fluid from the pump inlet 30 through an inlet port 28 located in a bottom bearing support plate 78, and the pump 22 discharges fluid through the outlet port 32 that is located in an upper portion of the housing 36. The outlet port 32 expels fluid into an inlet 40 of a control valve (not shown), where the inlet 40 is sealed to the housing 36 by an annular seal S. Although FIG. 1 illustrates the inlet 40 of the control valve and the housing 36 as separate components, the inlet 40 of the control valve can also be integrated with the housing 36 as well, and is illustrated below in FIG. 5.

Figure 2:
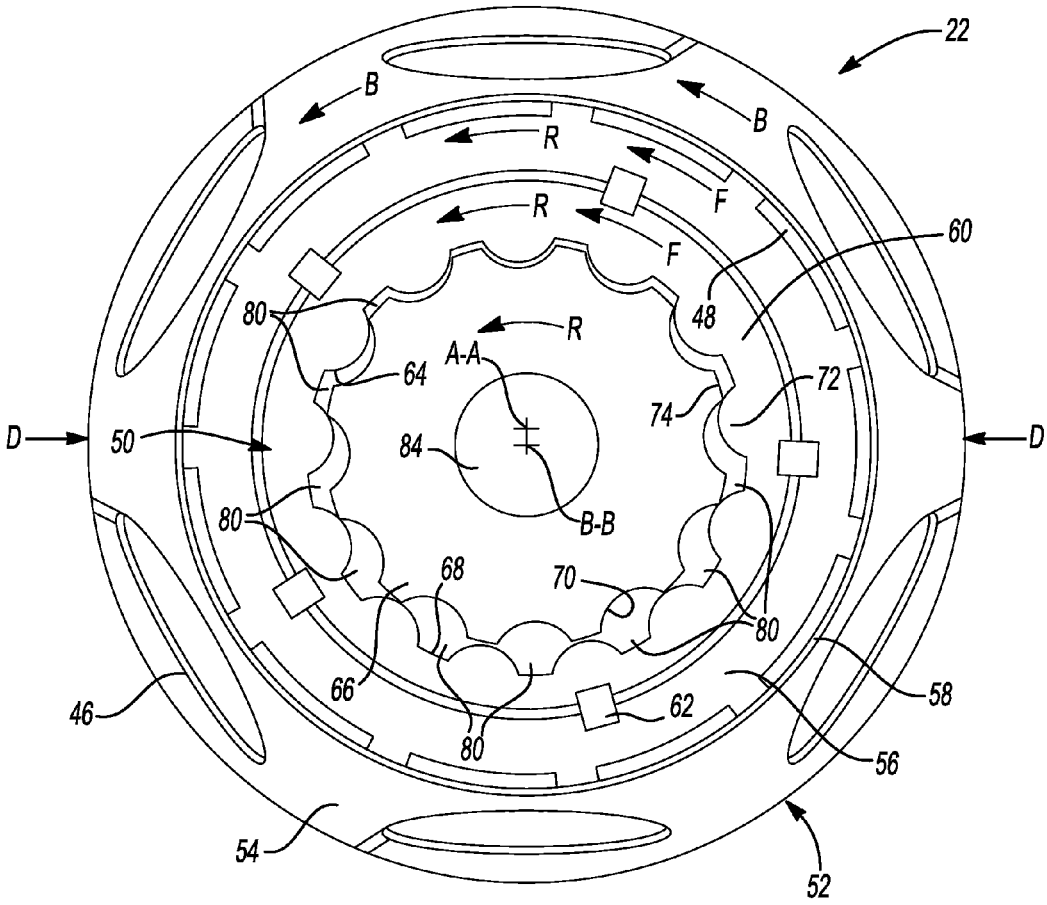
FIG. 2 is a cross sectioned view of the pump illustrated in FIG. 1, where the pump includes a motor and a gerotor pump.

FIG. 2 is an illustration of the internal components of the pump 22. The pump 22 includes an electric motor 52 and a gerotor pump 50, where the motor 52 surrounds the gerotor pump 50. The motor 52 includes an axis of rotation A-A and the gerotor pump 50 includes a second axis of rotation B-B. Referring to both FIGS. 1-2, the pump 22 is oriented in the reservoir 20 such that the axis of rotation A-A of the motor 52 and the second axis of rotation B-B of the gerotor pump 50 are generally aligned with the inlet 40 of the control valve. However, the axes A-A and B-B are parallel and offset relative to one another.

Referring to FIG. 2, the motor 52 includes a stator 54 and a rotor 56. The stator 54 is attached to the housing 36 (FIG. 1), and is a generally annular component that surrounds the rotor 56. An air gap 58 is located between the stator 54 and the rotor 56. In the example as illustrated, the motor 52 is an induction type three-phase motor, however one of skill in the art will appreciate that any type of electric motor may be used. The stator 54 is the stationary portion of the motor 52 that includes a plurality of windings 46 connected to a power source (not shown). When power is supplied to the windings 46 of the stator 54, a magnetic field B is created.

The rotor 56 is the non-stationary portion of the motor 52, where the rotor 56 is rotateable about the axis of rotation A-A of the motor 52. The rotor 56 includes a plurality of conductors 48, which cause the rotor 56 to rotate in a counterclockwise direction R as the magnetic field B induces a current in the conductors 48. Alternatively, in another embodiment the rotor 56 includes the windings 46 and the stator 54 includes the conductors 48. The rotor 56 is generally annular and surrounds an outer ring 60 of the gerotor pump 50. The outer ring 60 is coupled to the rotor 56 such that the rotor 56 exerts a driving force F on the outer ring 60, and the outer ring 60 rotates in the direction R about the axis of rotation A-A with the rotor 56. In the example as illustrated, the rotor 56 is coupled to the outer ring 60 by a plurality of tie bars 62, however one of skill in the art will appreciate that other types of fastening approaches may be used instead such as, for example, a splined engagement or a press fit.

The outer ring 60 includes an inner diameter contact surface 64 that defines a central opening 64 in the outer ring 60. The central opening 64 receives an inner ring 66 of the gerotor pump 50. The inner ring 66 includes an outer diameter contact surface 70 that selectively engages a portion of the inner diameter contact surface 68 of the outer ring 60. The central opening 64 of the outer ring 60 has a plurality of lobes or teeth 72, where the number of teeth 72 is designated by the quantity N+1. The inner ring 66 includes a plurality of mating teeth 74 along the outer diameter contact surface 70, where the number of mating teeth 74 is designated by the quantity N. In the embodiment as shown, the inner ring 66 includes twelve mating teeth 74, and the outer ring 60 includes thirteen teeth 72, however one of skill in the art will appreciate that any number of teeth may be used for the inner and outer rings as long as the outer ring 60 includes one more tooth than the inner ring.

The engagement between the teeth 72 of the outer ring 60 and the mating teeth 74 of the inner ring 66 transfers the driving force F from the outer ring 60 to the inner ring 66. The driving force F urges the inner ring 66 to rotate in the counterclockwise direction R about the second axis of rotation B-B. The second axis B-B is offset from the axis of rotation A-A of the outer ring 60, as the inner ring 66 includes one less mating tooth 74 than the outer ring 60. The inner ring 66 is supported by and rotates about a shaft 84. The shaft 84 is rotateably supported by the bearing support plate 78 located in the bottom of the housing 36 (FIG. 1) and is held in place by a center bolt 88 (FIG. 1).

The teeth 72 mesh with the mating teeth 74, where the teeth 72 and the mating teeth 74 cooperate with one another to create a plurality of spaces or chambers 80 between the inner and outer rings 60 and 66. The rotation of the inner ring 66 about the second axis B-B and the outer ring 60 about the axis of rotation A-A expand and contract the volume of the chambers 80. Referring back to FIG. 1, the chambers 80 receive fluid from the inlet port 28 of the pump 22. The expansion and contraction of the chambers 80 generates a pumping action that increases the pressure of fluid located within the chambers 80. The pressurized fluid is expelled as the chambers 80 contract in size, where fluid is expelled into the outlet port 32 located in the housing 36.

At least some types of conventional transmission oil pumps are driven by an exterior electrical motor, where the electric motor drives the shaft that supports the inner ring of the gerotor pump. These types of conventional pumps also include a seal between the shaft of the external electrical motor and the oil pump which can fail, causing a leak. In contrast, the motor 52 is located within the pump 22 and drives the outer ring 60 instead of the inner ring 66 of the gerotor pump 50. Moreover, because the motor 52 is located within the pump 22, the pump 22 may be less complex and require fewer parts than some types of conventional transmission oil pumps, resulting in lower cost. For example, the seal normally located between the shaft of the external electrical motor and the oil pump can be omitted with the pump 22.

Figure 3:
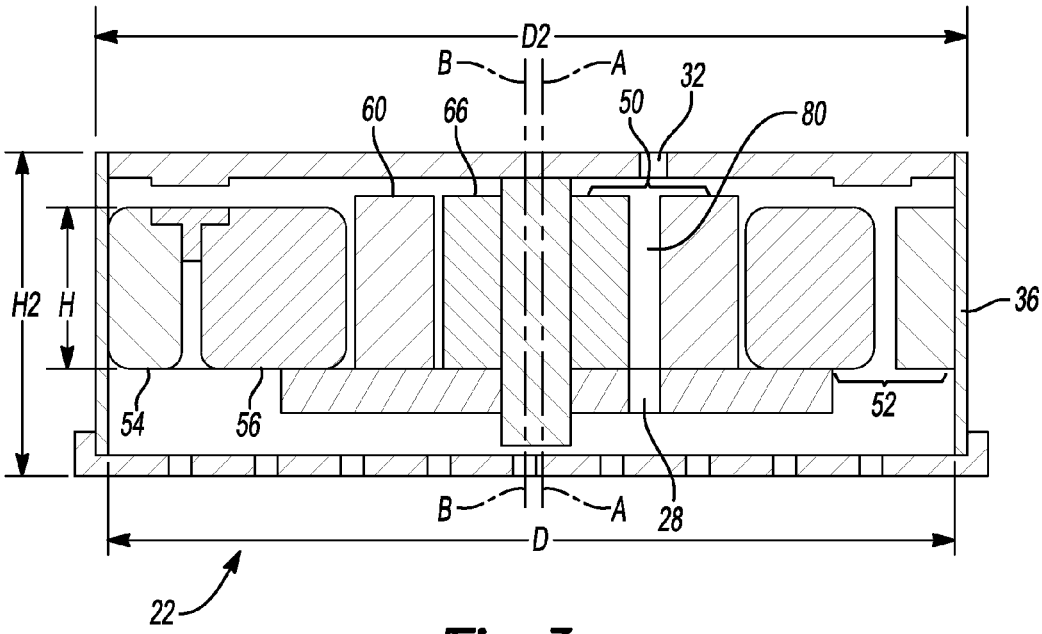
FIG. 3 is a side view of the pump illustrated in FIG. 2.

Referring to FIGS. 2-3, the motor 52 includes an overall outer diameter D, and a height H. Because the motor 52 surrounds both the inner and outer rings 60 and 66 of the gerotor pump 50, the diameter D of the motor 52 is several times greater than the diameter of some types of conventional motors used to drive the shaft that supports the inner ring of a gerotor pump. The relatively large diameter D of the motor 52 creates higher torque levels when compared to conventional motors used to drive gerotor pumps, as motor torque is proportional to the diameter of the motor. In one embodiment, the motor 52 could be an inductive motor, which is a lower cost alternative to the permanent magnet motor that is used for some types of conventional oil pumps. The motor 52 also includes a relatively large diameter-to-height ratio, where the diameter D is several times larger than the height H of the motor 52.

Turning to FIG. 3, the housing 36 of the pump 22 is dimensioned to accommodate the diameter D and the height H of the motor 52. The housing 36 includes a diameter D2 and a height H2, where the diameter D2 is several times greater than the height H2. In one embodiment, the diameter D2 of the housing 36 is about nine inches, and the height H2 is about one and a half inches, however one of skill in the art will appreciate that any number of different combinations for dimensions can be used for the housing 36. Because the housing 36 includes a relatively short height H2 when compared to the diameter D2, the pump 22 can be packaged in the reservoir 20 (FIG. 1), in a location where an oil filter would typically be found in a conventional transmission configuration.

Figure 4:
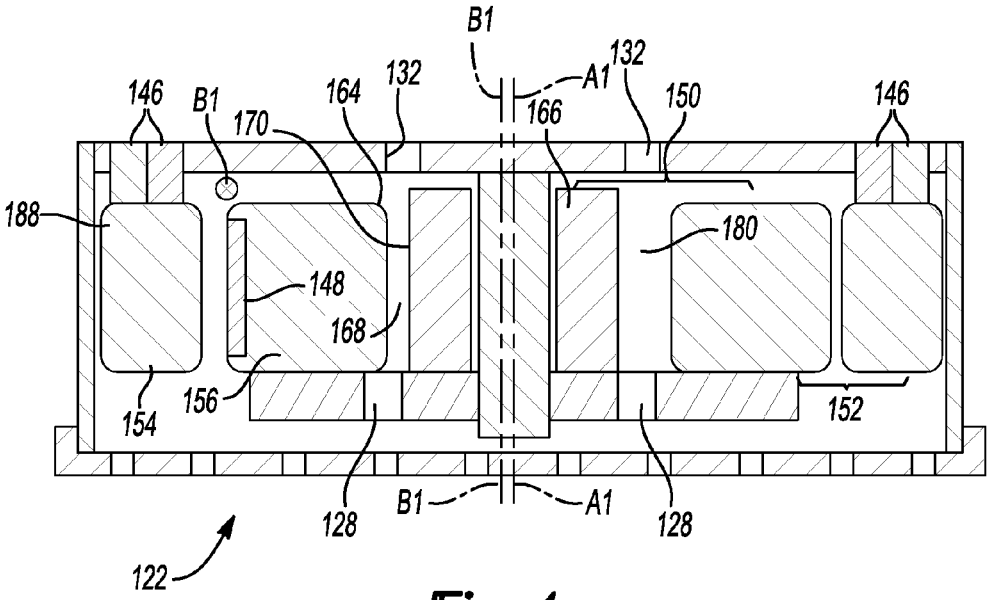
FIG. 4 is an alternative embodiment of the pump illustrated in FIG. 3.

FIG. 4 is an alternative embodiment of a pump 122 including a motor 152 and a gerotor pump 150, where the motor 152 surrounds the gerotor pump 150. The motor 152 includes a stator 154 and a rotor 156. In the embodiment as shown, the rotor 156 and an outer ring of the gerotor pump 152 (such as the outer ring 60 illustrated in FIGS. 1-3) are integrated into a single, unitary component. The rotor 156 is constructed of any type of conductive material such as, for example, a powder metal. The rotor 156 includes a plurality of conductors 148. A magnetic field B1 created by a plurality of windings 146 of the stator 154 induce a current in the conductors 148, which causes the rotor 156 to rotate about an axis of rotation A1-A1. The rotor 156 includes a central opening 164 for receiving an inner ring 166 of the gerotor pump 150, where the central opening 164 of the rotor 156 is defined by an inner diameter contact surface 168. The inner ring 166 includes an outer diameter contact surface 170 that selectively engages a portion of the inner diameter contact surface 168 of the rotor 156. The engagement between the rotor 156 and the inner ring 166 rotates the inner ring 166 about a second axis of rotation axis B1-B1. The rotation of the inner ring 166 about the second axis B1-B1 and the rotor 156 about the axis of rotation A1-A1 expand and contract a plurality of chambers 180, which generates a pumping action that increases the pressure of fluid located within the chambers 180. The pressurized fluid is expelled from the gerotor pump 150 and into an outlet port 132 located in the housing 136.

In the embodiment as illustrated, the plurality of windings 146 are end wound, which means that the windings 146 are located at an end 188 of the stator 154. Using end wound windings 146 can provide several benefits. For example, in relatively cold temperatures (usually less than about −25° C.) heat is produced in the windings 146. Because the pump 122 is submerged by fluid that is located within the interior volume of a reservoir (i.e., the reservoir 20 illustrated in FIG. 1), the heat generated by the windings 146 is dissipated to the fluid in the reservoir. The warmed fluid will then flow through an inlet port 128. Warmer fluid creates less cavitation in the inlet port 128 than colder fluid. Moreover, warmer fluid will benefit the transmission (not shown) as well. This is because warmer fluid sent through the inlet 40 to the control valve (FIG. 1) will produce less viscous force than a colder fluid, which improves fluid flow in the valve body of the control valve as well as clutch fill times for first clutch engagement of the transmission. Warmer fluid also reduces the amount of electric power used to operate the pump 122 during start-up at colder temperatures, which in turn reduces the load on the electric components of a vehicle, such as the alternator and battery. Finally, including end wound windings 146 may also potentially allow for the pressure at the inlet port 128 and the outlet port 132 to be balanced, which results in less noise produced by the pump 122 during operation.

Figure 5:
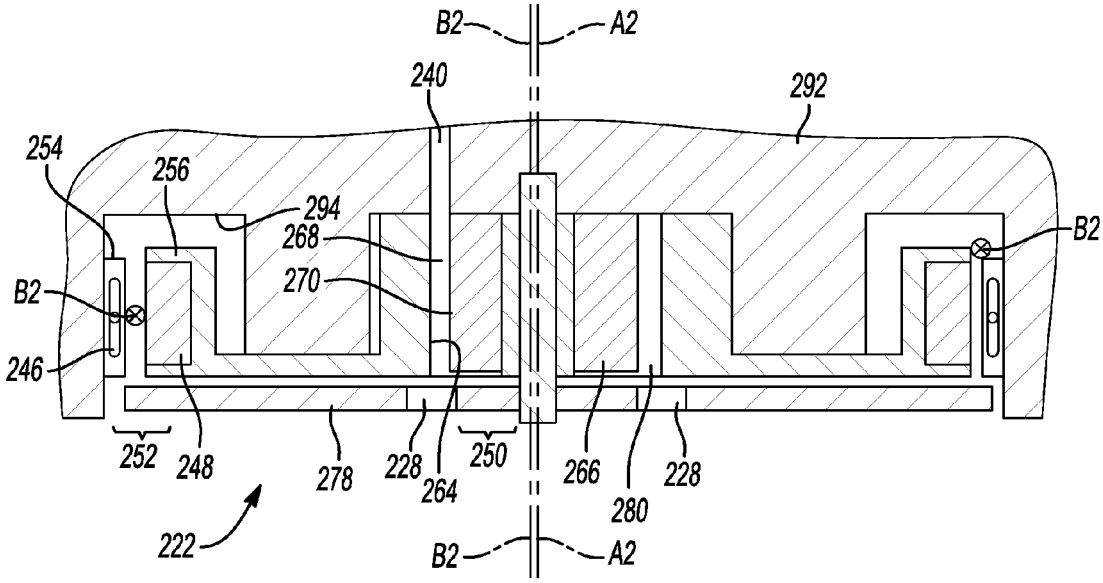
FIG. 5 is another alternative embodiment of the pump illustrated in FIG. 3.

In another embodiment as illustrated in FIG. 5, a pump 222 is provided that is integral with an inlet 240 of located in a body 292 of a control valve. Specifically, the valve body 292 defines a cavity 294 for receiving a motor 252 and a gerotor pump 250 of the pump 222. The motor 252 and the gerotor pump 250 are each supported by a bearing support plate 278 that includes at least one inlet port 228. The motor 252 includes a stator 254 and a rotor 256, where the stator 254 is attached to the valve body 292.

The rotor 256 and an outer ring of the gerotor pump 252 (such as the outer ring 60 illustrated in FIGS. 1-3) are integrated into a single, unitary component. The rotor 256 includes a plurality of conductors 248. A magnetic field B2 created by a plurality of windings 246 of the stator 254 induce a current in the conductors 248, which causes the rotor 256 to rotate about an axis of rotation A2-A2. The rotor 256 includes a central opening 264 for receiving an inner ring 266 of the gerotor pump 250, where the central opening 264 of the rotor 256 is defined by an inner diameter contact surface 268. The inner ring 266 includes an outer diameter contact surface 270 that selectively engages a portion of the inner diameter contact surface 268 of the rotor 256. The engagement between the rotor 256 and the inner ring 266 rotates the inner ring 266 about a second axis of rotation axis B2-B2. The rotation of the inner ring 266 about the second axis B2-B2 and the rotor 256 about the axis of rotation A2-A2 expand and contract a plurality of chambers 280, which generates a pumping action that increases the pressure of fluid located within the chambers 280. The pressurized fluid is expelled from the gerotor pump 250 and into the valve body 292 though the inlet 240.

The description of the invention is merely exemplary in nature and variations that do not depart from the gist of the invention are intended to be within the scope of the invention. Such variations are not to be regarded as a departure from the spirit and scope of the invention.

What is claimed is:

1. A gerotor pump, comprising:

an inner ring rotateable about an axis, wherein the inner ring has an outer diameter contact surface;

an outer ring having an inner diameter contact surface that defines a central opening within the outer ring, wherein the central opening receives the inner ring, and wherein a portion of the inner diameter contact surface engages a portion of the outer diameter contact surface of the inner ring; and a three phase induction motor including a rotor and a stator that surrounds the rotor, wherein the rotor surrounds the outer ring and exerts a driving force on the outer ring such that the outer ring rotates about the inner ring and the inner ring rotates about the axis, wherein the rotor and the outer ring are a single component, and wherein the inner diameter contact surface of the outer ring and the outer diameter contact surface of the inner ring creates a plurality of chambers, wherein rotation of the inner ring and the outer ring expand and contract the chambers to generate a pumping action that increases pressure of fluid located within the chambers, and wherein fluid is expelled from the gerotor pump as the chambers contract in size.

2. The gerotor pump of claim 1 wherein the motor is end wound.

3. The gerotor pump of claim 2 wherein the windings dissipate heat to fluid located in the gerotor pump.

4. The gerotor pump of claim 1 wherein the gerotor pump includes an inlet side, and wherein the inlet side includes an inlet screen.

5. The gerotor pump of claim 1 wherein the gerotor pump includes an outlet port, wherein the outlet port expels fluid into an inlet of a control valve.

6. The gerotor pump of claim 1 wherein the gerotor pump includes a housing that is part of a control valve body.

7. The gerotor pump of claim 1 wherein an outside diameter of a housing of said pump is at least about four times greater than a height of said housing.

8. A transmission, comprising:

a reservoir for receiving fluid, wherein the reservoir includes an interior volume;

a gerotor pump that is at least partially located within the interior volume of the reservoir, the gerotor pump comprising:

an inner ring rotateable about an axis, wherein the inner ring has an outer diameter contact surface;

an outer ring having an inner diameter contact surface that defines a central opening within the outer ring, wherein the central opening receives the inner ring, and wherein a portion of the inner diameter contact surface engages a portion of the outer diameter contact surface of the inner ring; and a three phase induction motor including a rotor and a stator that surrounds the rotor, wherein the rotor surrounds the outer ring and exerts a driving force on the outer ring such that the outer ring rotates about the inner ring and the inner ring rotates about the axis, wherein the rotor and the outer ring are a single component, and wherein the inner diameter contact surface of the outer ring and the outer diameter contact surface of the inner ring creates a plurality of chambers, wherein rotation of the inner ring and the outer ring expand and contract of the chambers to generate a pumping action that increases pressure of fluid located within the chambers, and wherein fluid is expelled from the gerotor pump as the chambers contract in size.

9. The transmission of claim 8 wherein the reservoir is a transmission oil pan.

10. The transmission of claim 8 wherein the motor is a three phase motor.

11. The transmission of claim 8 wherein the motor is end wound.

12. The transmission of claim 8 wherein the gerotor pump includes an inlet side, and wherein the inlet side includes an inlet screen.

13. The transmission of claim 8 wherein the gerotor pump includes an outlet port, wherein the outlet port expels fluid into an inlet of a control valve.

14. The transmission of claim 8 wherein the gerotor pump includes a housing that is part of a control valve body.

15. The transmission of claim 8 wherein the transmission includes a control valve having an inlet, wherein an outlet of the gerotor pump connects to the inlet of the control valve.

16. The transmission of claim 8 wherein the gerotor pump includes an inlet side having an inlet screen, wherein the inlet is located within the interior volume of the reservoir.

17. The transmission of claim 8 wherein an outside diameter of a housing of said gerotor pump is at least about four times greater than a height of said housing.

18. The transmission of claim 8 wherein the motor windings dissipate heat to the fluid.

* * * * *